US007270450B2

(12) United States Patent
Chan

(10) Patent No.: US 7,270,450 B2
(45) Date of Patent: Sep. 18, 2007

(54) LIGHTING AND FLASHING CHRISTMAS TREE STRUCTURE APPARATUS

(75) Inventor: Tsung-Wen Chan, Taipei (TW)

(73) Assignee: Topson Optoelectronics Semi-conductor Co. Ltd., Taoyuan (TW)

( * ) Notice: Subject to any disclaimer, the term of this patent is extended or adjusted under 35 U.S.C. 154(b) by 0 days.

(21) Appl. No.: 11/313,666

(22) Filed: Dec. 22, 2005

(65) Prior Publication Data

US 2007/0147028 A1 Jun. 28, 2007

(51) Int. Cl.
*F21V 21/00* (2006.01)

(52) U.S. Cl. ..... 362/398; 362/806; 362/800; 362/431

(58) Field of Classification Search ..... 362/398, 362/806, 410, 411, 431, 251, 231, 800, 123
See application file for complete search history.

(56) References Cited

U.S. PATENT DOCUMENTS 2,916,608 A * 12/1959 Brown ..... 362/122

* cited by examiner

*Primary Examiner*—Sharon Payne

(57) ABSTRACT

A lighting and flashing Christmas tree structure apparatus employs a low power control circuit to control the flashing sequence of LED light strings, capable of randomly altering distribution of the light strings with free choice of colors. A plug-free magnetic power system supplies electrical power to a cuboidal body where each of the four sides thereon has an electrical power receptacle free for user selection. With a LED device controller, a magnificent blinking is emitting from the LED light source to delight Christmas atmosphere. The electrical power offered by the present invention is limited below 24 V, which is within the safety range of the electrical properties code for body contact, therefore being free of safety concerns.

4 Claims, 7 Drawing Sheets

LIGHTING AND FLASHING CHRISTMAS TREE STRUCTURE APPARATUS

BACKGROUND OF THE INVENTION

1. Field of the Invention

The present invention relates to a lighting and flashing Christmas tree structure apparatus, in particular, to a lighting and flashing Christmas tree structure apparatus that features a plug-free electrical power system with multiple power receptacles to supply LED drive currents, a low power control circuit to control the flashing sequence of LED light strings and randomly altering distribution of the light strings with free choice of colors.

2. Description of the Prior Art

The most popularly seen and preferred types of traditional Christmas trees are mostly a composition of integral parts of a tree trunk. To beautify an overall Christmas tree complex, a variety of ornaments are usually hung and Christmas lamps are wound around the trunks, followed by a power line connected to each lamp to illuminate the lamp, thus making the tree gorgeous and decorating the holiday with joy.

The Christmas trees mentioned in the foregoing are enriched with gorgeousness and the joys of the Christmas holiday by the shining of the lamps, but there are some defects in the actual usage:

1. The traditional Christmas trees have Christmas decorative lighting by tiny glass bulbs which are not the economical way of lighting and consume higher power that causes contamination, labors, hazardousness and being costly.
2. The traditional Christmas trees demand 3-wire power plug and extra efforts for installing decorative lighting that results in safety concerns.
3. The add-on process for the manufacture of the traditional Christmas lamps is not available for automatic testing, and the assembly is also tedious, limiting the production rate and raising the costs.
4. The method of manufacturing the traditional Christmas trees is not only costly, lengthy, and low in product yield rate, but quality assurance and production requirements fail to meet total quality control, which deteriorate safety and cost control.
5. The whole light string in the traditional Christmas trees goes down only if one fails which is very annoying.

SUMMARY OF THE INVENTION

It is an object of the present invention to offer an innovative lighting and flashing Christmas tree structure apparatus that features multiple power receptacles, the control of a flashing sequence of LED light strings by means of a low power control circuit, randomly altering the distribution of light strings with free choice of colors, and provision of magnetic contacts and free selection of a preferred power receptacle.

Another object of the invention is to replace power plugs with the magnetic contacts for electrical conduction, simplifying production assembly to spare resources.

A further object of the invention is to provide a mode of inputting electrical power by diminishing windings of lamp strands with the magnetic contacts, and through the simple mode of electricity supplying to simplify the prior production approach, which will substantially help in cutting down labor costs.

A still further object of the invention is to use the magnetic contacts to connect to the LEDs and to append a limiting resistor to it. The value of the limiting resistor is dependent on the number of LEDs in series, which is used for limiting unexpected surges in electrical power from burning the LEDs. The process of manufacturing the magnetic contact is plain and testing for add-on process is easy. The magnetic contact is electricity economizing so that there is no overload in the circuit which ensures the safety in operating and longer life in use.

A still further object of the invention is to provide a low power connection by the magnetic contact where the low power is 24Vac or 24Vdc signal voltage which is within the safety range of the electrical properties code for body contact; therefore, wavering the UL safety certification and CE safety and EMC approvals, which tremendously shortens the shipment and strengthens product competition.

A still further object of the invention is to offer users required lighting colors for performing DIY in the design of Christmas tree lighting, free of electric shock and safety concerns, and easy for replacement by replacing the malfunction part only.

The lighting and flashing Christmas tree structure apparatus having the foregoing advantages according to the present invention comprises:

A conductive tube, which is a body, has multiple orifices, where the body may take different shapes having cross section as a rectangle, a circle, or a trapezoid;

A conductive plate, which is adhered to the body, has an area smaller than that of each surface of the body, where the shape may take a belt;

An insulator, which is attached to the back side of the conductive plate, has an area bigger than the plate, isolating the conductive plate from the conductive tube for the insulation;

A pole, which is an elongated rod, is used for inserting into and being fastened to an orifice of the body. There may be several ways for fastening the pole as follows:

(1) The apparatus has a hollow body. The body has arrays of orifices disposed on its sides, and the pole has a protrusion and a hoop at the bottom end. The protrusion has an elastic nature that facilitates itself easily into the front edge of the orifice and out from the back edge of the orifice of the body. The hoop is affixed tightly to the front edge of the orifice as a fulcrum while both edges of the orifice act as pivotal points to fix the pole.

(2) The orifice of the body is formed into a female screw, and the bottom end (inserted part) of the pole is acted as a male screw. Once the pole is inserted into the orifice, the male and the female are joined precisely only by a twist and the pole is fixed firmly.

A LED, which is an illumination device, forms into a LED light string by combining with multiple LEDs in winding around the pole;

A conduction and magnet unit, which is a magnetic contact plug joining the LED light string together in series, where the unit has two contact terminals at its both ends, one terminal is represented for a minus magnetic pole and the other for a plus magnetic pole. Both terminals are in physical contact with the conductive tube and the conductive plate respectively. A limiting resister is mounted on the unit and is in series with the LED light string to protect the LEDs from burning by unexpected surges in electrical power;

A LED illumination device controller, which is connected to the conductive tube and the conductive plate, is capable of altering the color and lighting sequence of the illumination devices;

A power supply, which is connected to the LED illumination device controller, supplies a low power for signal use;

A conductive tube base, which has the conductive tube on its top, fastens the tube to sit upright on it.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
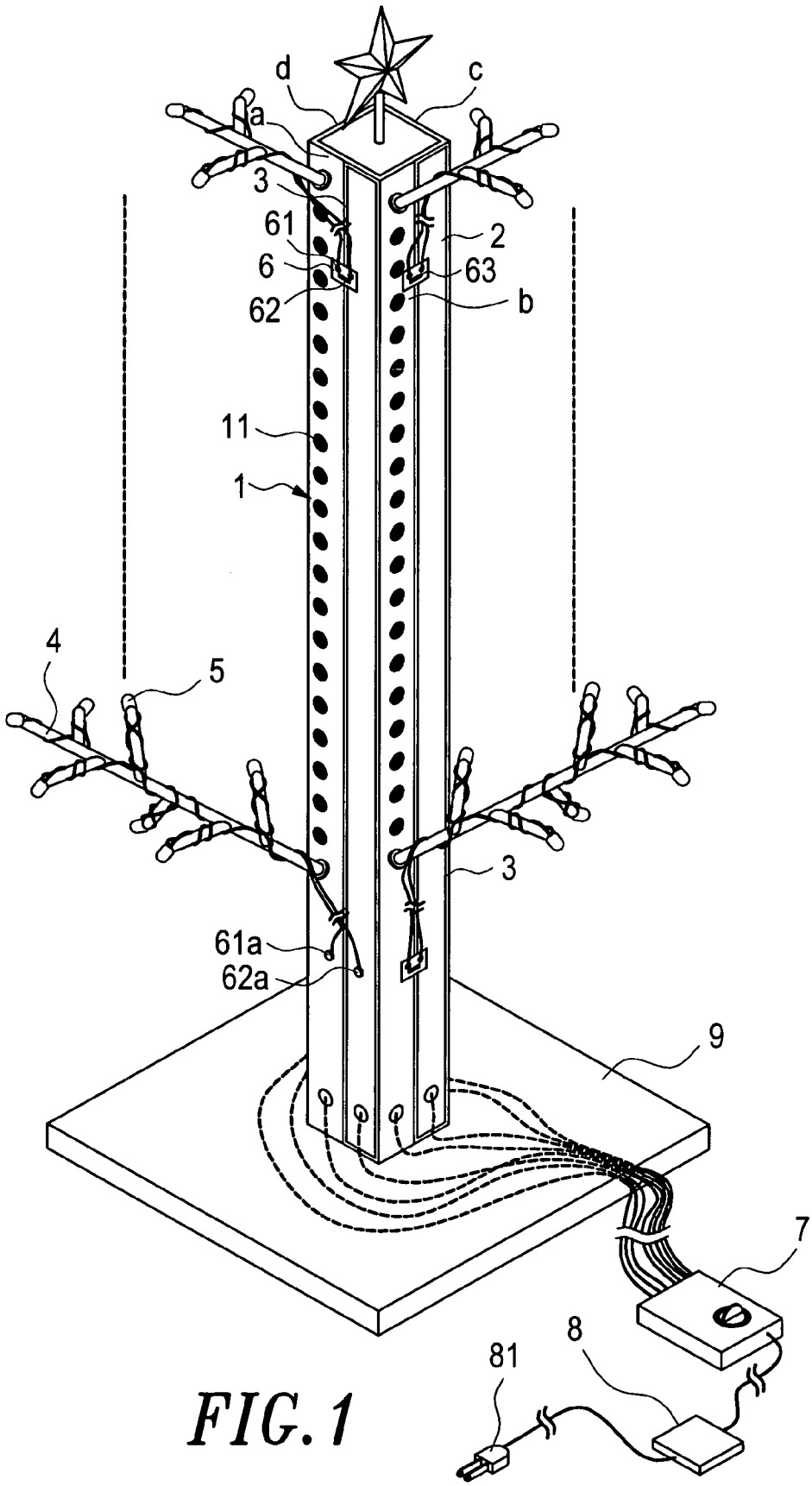
FIG. 1 is a three dimensional complete view of the present invention.

FIG. 1 is a three dimensional complete view of the present invention. Referring to FIG. 1, the lighting and flashing Christmas tree structure apparatus according to the present invention comprises:

A conductive tube 1, which is a body, has multiple orifices 11, where the cross section of the tube 1 is a rectangle and the four sides are: a, b, c, and d. The tube 1 may take different shapes having a cross section as a circle or a trapezoid. The preferred embodiment of the conductive tube 1 is a cuboid;

A conductive plate 2, which is adhered to the sides: a, b, c, and d each for the tube 1, has an area smaller than each side of the tube 1. The shape of the conductive plate 2 is a rectangle;

An insulator 3, which is adhered to the back side of a conductive plate 2 of the four sides, a, b, c, and d each for the tube 1, has an area bigger than the plate 2, capable of isolating the conductive plate 3 from the conductive tube 1 for the insulation;

A pole 4, which is an elongated rod, is used for inserting into and being fastened to an orifice 11 disposed on the body;

A LED 5, which is an illumination device, forms into a LED light string by combining with multiple LEDs in winding around the pole 4;

A conduction and magnet unit 6, which is a magnetic contact plug joining the LED 5 light string in series, has two contact terminals at its both ends, one terminal is represented for a minus magnetic pole 61 and the other for a plus magnetic pole 62. Both terminals of the unit 6 are in physical contact with the conductive tube 1 and the conductive plate 2 respectively, with a free choice for attaching on any of the sides: a, b, c, and d of the tube 1. A limiting resister 63 is mounted on the unit 6 and is in series with the LED light string to protect the LEDs 5 from burning by unexpected electrical power surges. The unit 6 may have the two contact terminals designed to be freely detachable, where one terminal is a detachable minus magnetic pole 61*a* and the other a plus magnetic pole 62*a*.

A LED illumination device controller 7, which is connected to the conductive tube 1 and the conductive plate 2, is capable of altering the color and lighting sequence of the illumination devices LEDs 5.

A power supply 8, which is connected to the LED illumination device controller 7, has a plug 81 through which the home electrical power source (110V or 220V) is available for use by the power supply 8. The power supply 8 is also responsible for the conversion of the home power into a low power having a voltage below 24Vdc or 24Vac for the signal use of the present invention;

A conductive tube base 9, which has the conductive tube 1 on its top, fastens the tube 1 to sit upright on it.

Figure 2:
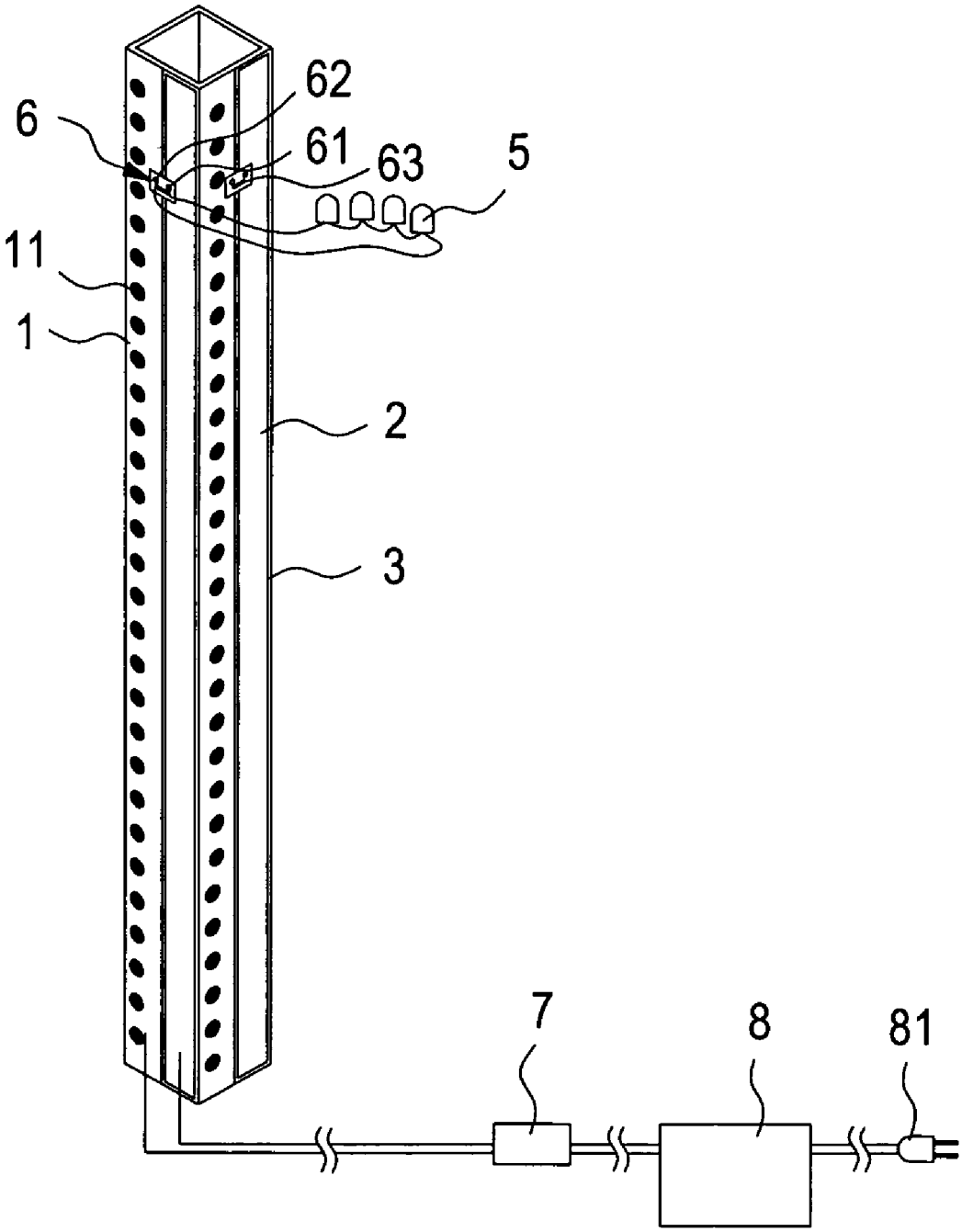
FIG. 2 is a schematic view of a simplified embodiment of the present invention.
Figure 2A:
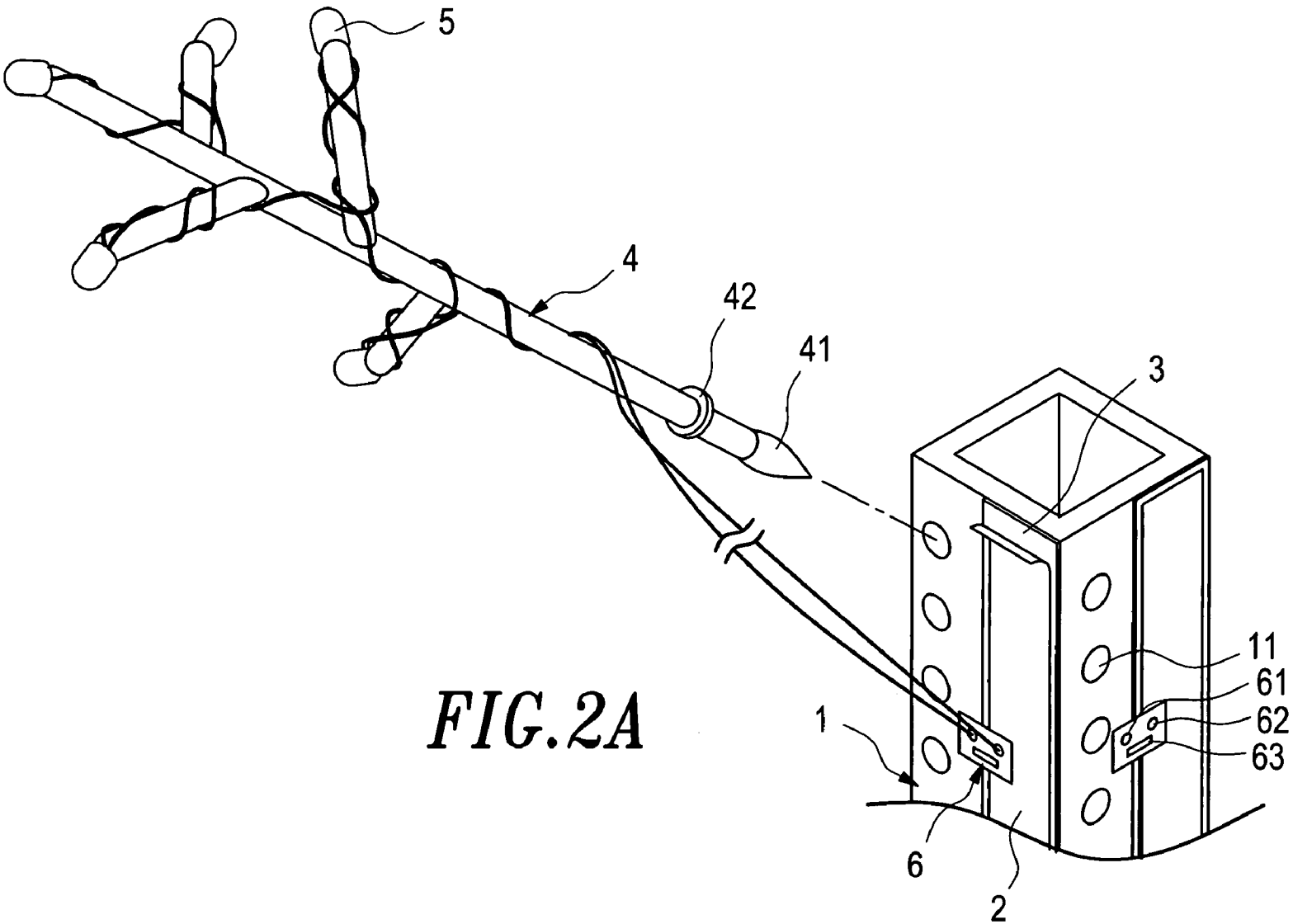
FIG. 2A is an enlarged schematic view of a simplified embodiment of the present invention.
Figure 2B:
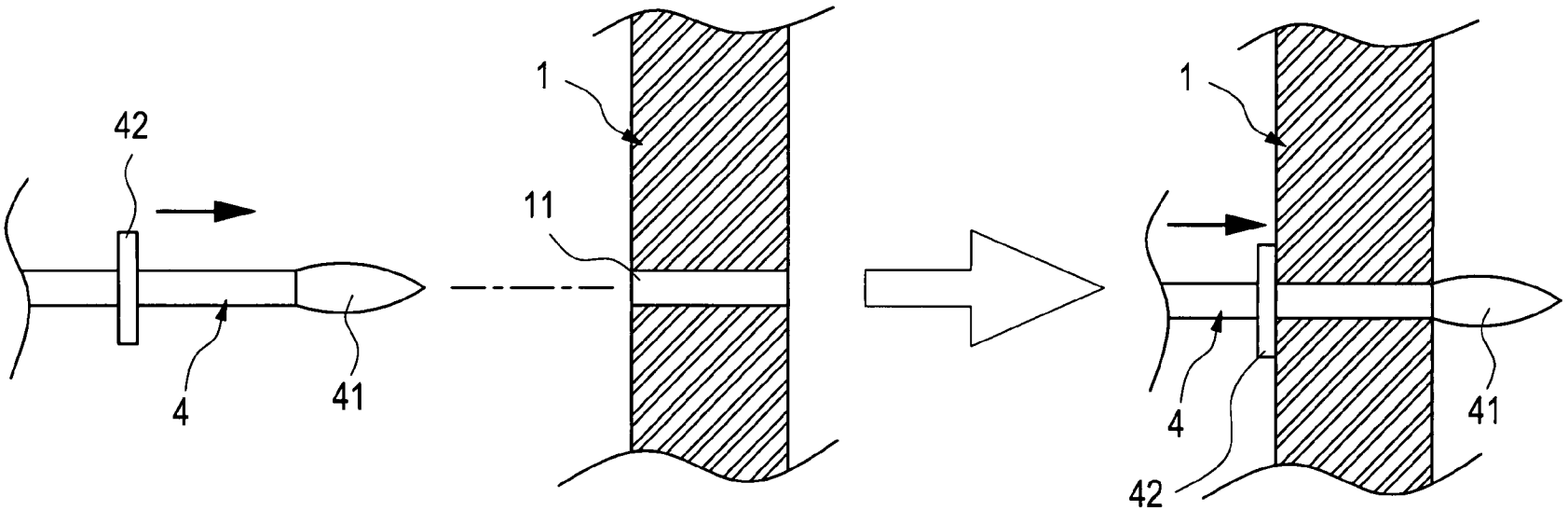
FIG. 2B is a moving schematic view of a pole inserting into an orifice disposed on the conductive tube of the present invention.

FIG. 2 is a schematic view of a simplified embodiment of the present invention. FIG. 2A is an enlarged schematic view of a simplified embodiment of the present invention. FIG. 2B is a moving schematic view of a pole inserting into an orifice disposed on the conductive tube of the present invention. The following description are referring to FIG. 2, FIG. 2A, and FIG. 2B.

A conduction and magnet unit 6 is a magnetic contact plug, attaching to the conductive tube 1 and the conductive plate 2 by its own magnetism, and joining the LED 5 light string in series.

A conductive plate 2 has an insulator 3 adhered to its back, where the insulator 3 is to isolate the conductive plate 2 from the conductive tube 1 for the insulation.

A conduction and magnet unit 6 has two contact terminals at its both ends, where one terminal is represented for a minus magnetic pole 61 and the other for a plus magnetic pole 62. Both terminals of the unit 6 are in physical contact with the conductive tube 1 and the conductive plate 2 respectively. The polarities of the tube 1 and the plate 2 are adjustable.

Once the power supply 8 is powered through its plug 81 by plugging into a power source, followed by both terminals of the unit 6 being in physical contact with the conductive tube 1 and a conductive plate 2, a LED is triggered to emit light. The number of LEDs in series lies between 1 and 12, according to the user's preference.

The color of LEDs can be controlled by means of a LED illumination device controller 7, and the lighting sequence of the LED light string could also be altered. Either the different colors of LEDs illuminating in sequence or randomly can be controlled by the controller 7, which produces a variety of lighting and makes the Christmas tree according to the present invention filled with magnificent lighting and blinking to delight the holiday season atmosphere.

The pole 4 is an elongated rod used for inserting into and being fastened to an orifice 11 disposed on the conductive tube 1. An embodiment of fastening the pole (the ways for fastening the pole are quite many, the present invention only takes one for description) is as follow:

The body having an empty space in the inside, has arrays of orifices 11 disposed on its sides, and the pole 4 has a protrusion 41 and a hoop 42 at its bottom end. The protrusion 41 has an elastic nature that facilitates itself easily into the front edge of the orifice 11 and out from the back edge of the body. The hoop 42 is affixed tightly to the front edge of the orifice 11 as a fulcrum while both edges of the orifice 11 act as pivotal points to fix the pole 4.

Figure 3:
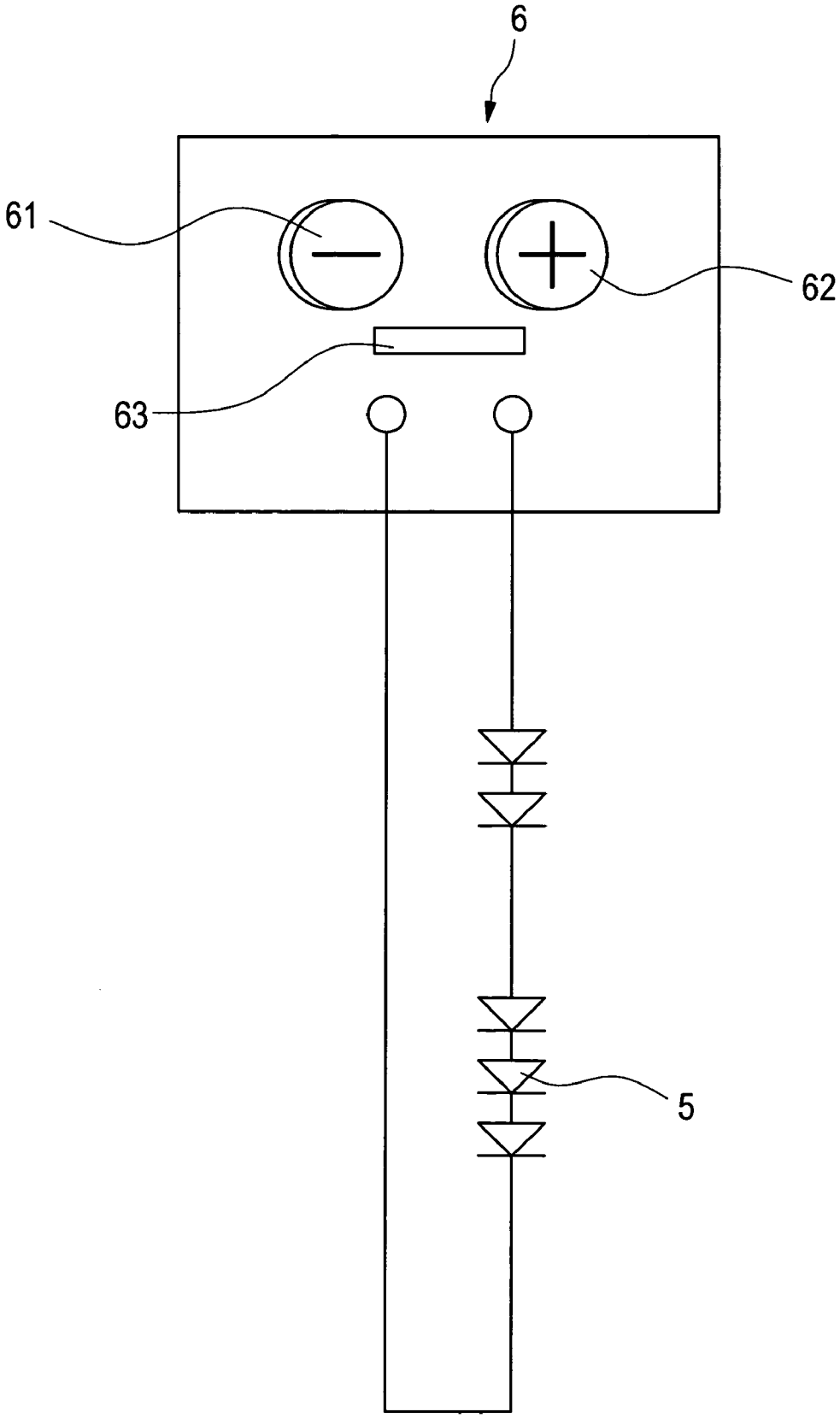
FIG. 3 is a schematic view of a circuit having LEDs and the conduction and magnet unit of the present invention.
Figure 3A:
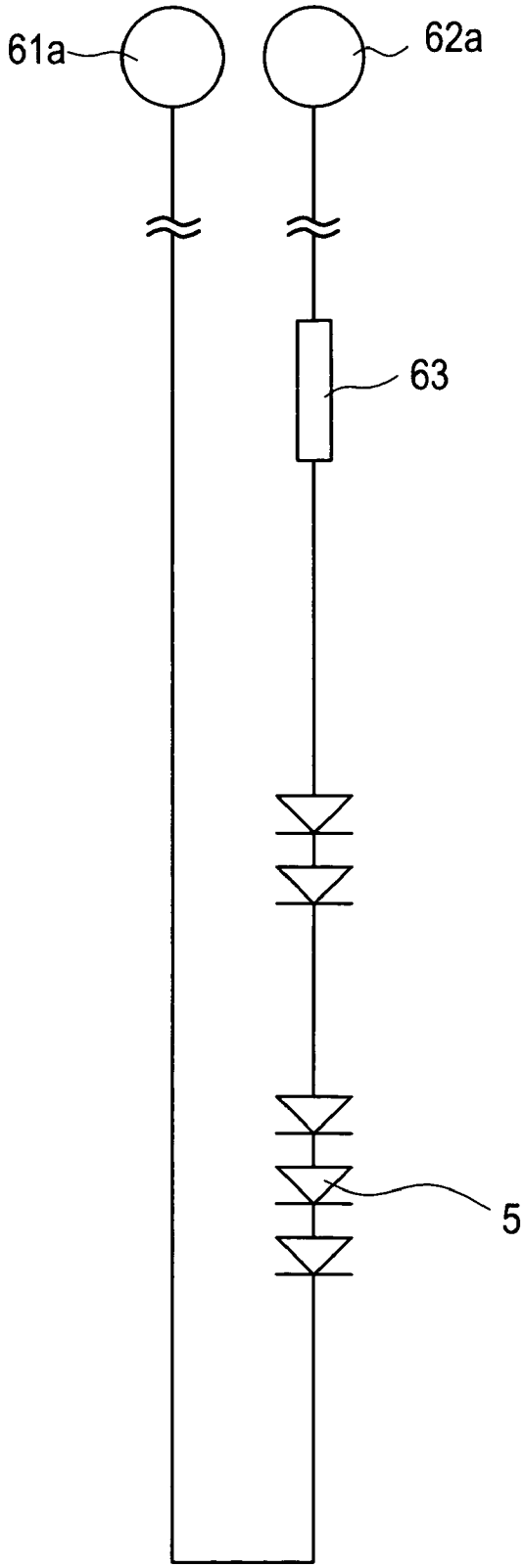
FIG. 3A is a schematic view of another embodiment of a circuit having LEDs and the conduction and magnet unit of the present invention.

FIG. 3 is a schematic view of a circuit having the LEDs and the conduction and magnet unit of the present invention. FIG. 3A is a schematic of another embodiment of a circuit having the LEDs and the conduction and magnet unit of the present invention. The following description are referring to FIG. 3 and FIG. 3A. There are two kinds of embodiments of the circuit having the LEDs 5 and the conduction and magnet unit 6, one is a stationary type as shown in FIG. 3 and the other is a detachable type as shown in FIG. 3A.

The difference between the two embodiments is that the stationary type embodiment has a circuit mounted on the printed circuit board which includes a minus magnetic pole 61, a plus magnetic pole 62, and a limiting resister 63, and these components join the LED light string in series.

The detachable type embodiment is a circuit composed of discrete devices in series, where a minus magnetic pole 61 and a plus magnetic pole 62 are both detachable. The circuit also includes a limiting resister 63, which all together joins the LED light string in series.

The multiple LEDs 5 are linked together to form a light string, where the number of LEDs lies between 1 and 12, according to the user's preference. As the number of LEDs varies, so does the value of the limiting resister 63.

Figure 4:
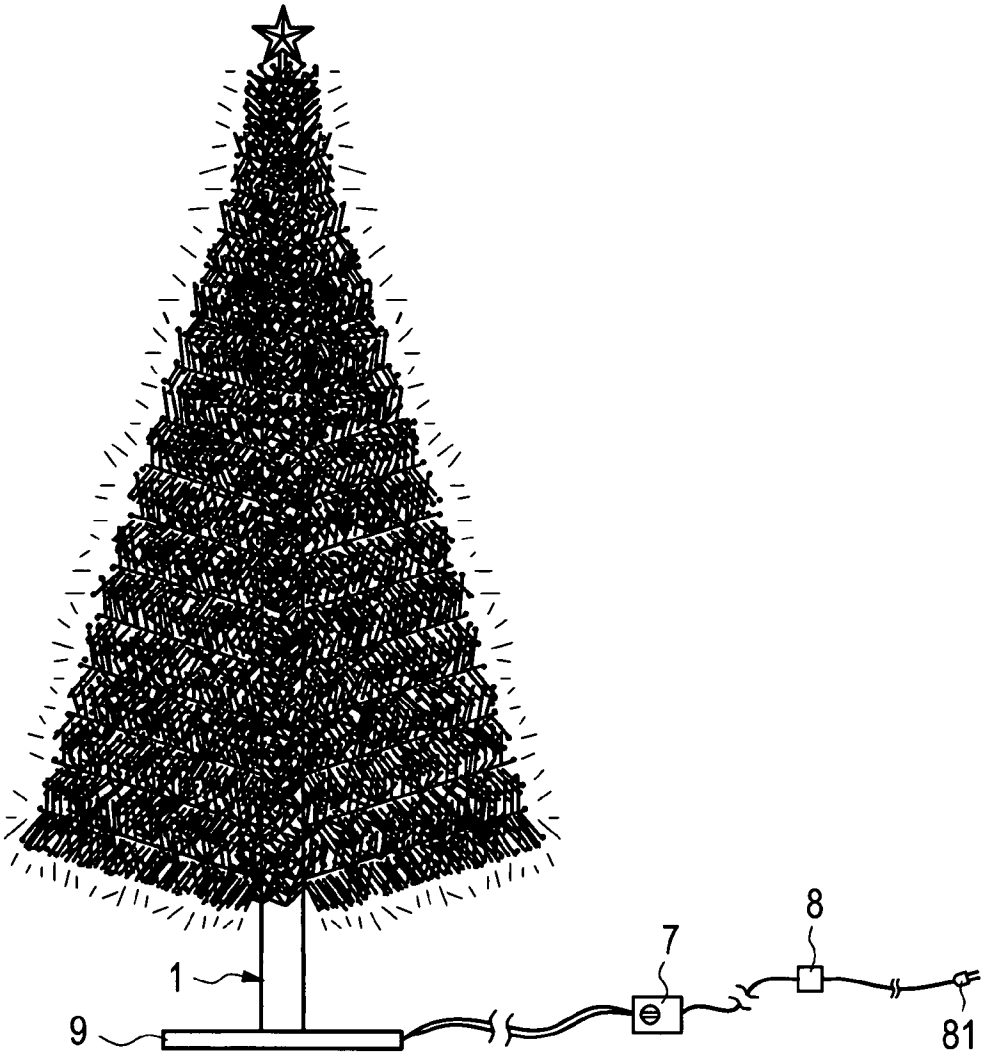
FIG. 4 is a schematic view of the embodiment of the present invention.

FIG. 4 is a schematic view of the embodiment of the present invention.

Referring to FIG. 4, the users could hang Christmas decorations on the pole 4 or wind a light string formed by the multiple of the LEDs around the pole 4. The users could also alter the distribution of the light string, control the flashing sequence, and randomly choose colors of the LEDs.

The use of the Christmas tree of the present invention is activated by an electrical power below 24V, which is high enough to energize the Christmas tree lighting, and enable the light source emitting magnificent blinking to delight the holiday season atmosphere.

While the present invention has been illustrated in detail herein with reference to the preferred embodiments thereof, the present invention is not intended to be limited by the embodiments. Any equivalent embodiments or modifications without departing from the spirit and scope of the present invention are therefore intended to be embraced.

What is claimed is:

1. A lighting and flashing Christmas tree structure apparatus, comprising:

a conductive tube, which is a body, taking a shape and having a plurality of orifices disposed thereon;

a conductive plate, adhered to the body, taking a shape and having an area smaller than that of the sides of the conductive tube;

an insulator, adhered to the back of the conductive plate, having an area bigger than the conductive plate, and isolating the conductive plate from the conductive tube for the insulation;

a pole, which is an elongated rod, for inserting into an orifice disposed on the body;

a conduction and magnet unit, which is a magnetic contact plug, having two contact terminals, wherein one terminal of the unit is in physical contact with the conductive tube, and the other terminal is in physical contact with the conductive plate;

an LED, which is an illumination device, forming into an LED light string by combining with a plurality of the LEDs and joining the conduction and magnet unit in series in winding around the pole;

an LED illumination device controller, connected to the conductive tube and the conductive plate, capable of altering a color and lighting sequence of the illumination devices;

a power supply, connected to the LED illumination device controller, wherein the power supply has a plug through which the home power source is available for use, being capable of converting a home power into a low power for the signal use of the present invention;

a conductive tube base, accommodating the conductive tube on its top, and fastening the tube to sit upright on it.

2. A lighting and flashing Christmas tree structure apparatus as in claim 1, wherein the shape of the conductive tube has a rectangular cross section.

3. A lighting and flashing Christmas tree structure apparatus as in claim 1, wherein the two contact terminals at both ends of the conduction and magnet unit has one terminal being represented for a minus magnetic pole while the other for a plus magnetic pole.

4. A lighting and flashing Christmas tree structure apparatus as in claim 1, wherein the power supply is responsible for supplying a low power having a voltage below 24V for the signal use.

* * * * *